US005711500A

United States Patent [19]

De Los Santos

[11] Patent Number: 5,711,500

[45] Date of Patent: Jan. 27, 1998

[54] BABY BOTTLE HOLDER

[76] Inventor: Victor De Los Santos, 533 Mountain Crest Dr., Duarte, Calif. 91010

[21] Appl. No.: 515,908

[22] Filed: Aug. 16, 1995

[51] Int. Cl.[6] ..... A47D 15/00

[52] U.S. Cl. ..... 248/102

[58] Field of Search ..... 248/102, 103, 248/104, 105, 106, 309.1

[56] References Cited

U.S. PATENT DOCUMENTS

| | | | |
|---|---|---|---|
| 1,729,531 | 9/1929 | Wolever | 248/105 |
| 2,033,296 | 3/1936 | Porter | 248/102 |
| 2,451,846 | 10/1948 | Love et al. | 248/105 |
| 2,841,349 | 7/1958 | Charles | 248/104 |
| 2,948,499 | 8/1960 | Manny | 248/106 |
| 3,144,230 | 8/1964 | Brooks | 248/102 |
| 3,850,393 | 11/1974 | Marguard | 248/102 |
| 5,459,903 | 10/1995 | Treacy | 248/102 X |
| 5,513,885 | 5/1996 | Joffe | 248/102 X |

*Primary Examiner*—Derek J. Berger
*Attorney, Agent, or Firm*—William H. Maxwell

[57] ABSTRACT

A baby bottle holder that may be biased against a person holding the baby, or rested upon the baby, for stability with at least one hand of the person being free to do other things, and by the baby with or without hands. Also, the holder has adjustable features for shifting the holder and the bottle within the holder to achieve comfortable positioning for feeding the baby.

10 Claims, 1 Drawing Sheet

BABY BOTTLE HOLDER

BACKGROUND OF THE INVENTION

1. Field of the Invention

This invention relates to a baby bottle holder that may be worn by a person feeding a baby or rest on the baby for self feeding.

2. Description of the Prior Art

There have been bottle holders used in the prior art that include a weighted portion and straps that will surround a baby bottle that has been nestled in the weighted section. The disadvantage of such devices is that they are not adjustable for babies of varying sizes. Also if the holder is to be placed on a baby's chest the weight may be too great upon the child.

Further, there have been no bottle holders that a person feeding the baby could use with only one hand. They have had to utilize both hands. That is using one arm and hand to hold the baby and the other hand to hold the bottle and guide the bottle to the baby's mouth. This does not allow for the person feeding to have one free hand to do other things, such as cooking, etc.

SUMMARY OF THE INVENTION

It is a purpose of the present invention to provide a light weight relatively inexpensive baby bottle holder.

Another object of the present invention is to provide a baby bottle holder that has several positions for receiving or holding a baby bottle.

A yet further object of the present invention is to provide a baby bottle holder that includes a strap to be placed around the neck of a person feeding a baby so that the holder is suspended from the strap and may be braced against the chest of the person and the bottle placed therein to be available for the baby to feed. Thus only one hand and arm is required in the feeding process.

A still further object of the present invention is to provide a baby bottle holder having an exterior contour to fit comfortably against a chest of the person feeding the baby.

Another object of the present invention is to provide a baby bottle holder that also has an exterior contour to accommodate buttons or protrusions on a baby's clothes so that the chances of tipping over are reduced or eliminated when resting on a baby's chest.

A yet further object of the invention is to provide a baby bottle holder that may be generally described as frusto triangular, wherein the legs of a triangle taper so that when resting against the chest of a person holding and feeding the baby, the bottle will remain in position so as to require use of only one arm and hand holding the baby with the other arm and hand free to do other chores.

These and other objects and advantages will become apparent from the following part of the specification wherein details have been described for the competence of disclosure, without intending to limit the scope of the invention which is set forth in the appended claims.

BRIEF DESCRIPTION OF THE DRAWINGS

These advantages may be more clearly understood from the following description in which.

DETAILED DESCRIPTION OF THE PREFERRED EMBODIMENT

Figure 1:
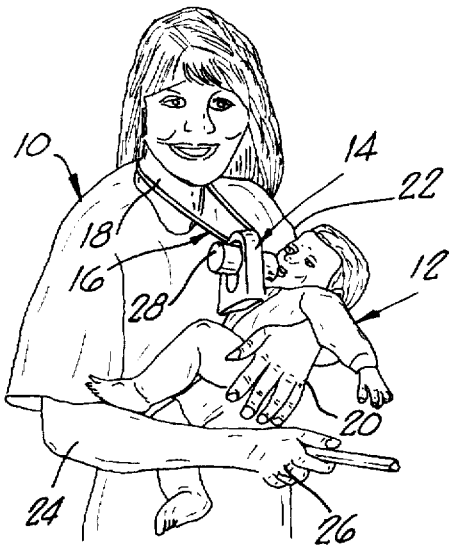
FIG. 1 is an environmental view of the baby bottle holder in position on the person feeding the baby as well as the baby also.

In the environmental view of FIG. 1 there is seen a person 10 that is feeding a baby 12 by the use of the present invention of a baby bottle holder generally designated 14.

With the holder 14 that includes a neck cord designated 16 in position around a neck 18 the person 10 may hold the baby 12 with the left arm 22. This will leave the right arm 24 and hand 26 free to cook or do other chores. Of course the opposite is true if the person 10 is left handed in which case the hands and holder 14 are reversed.

With the holder 14 cinched up to the proper elevation by the neck cord 16, the holder is biased against the chest of the person 10 and also may rest on the baby 12. In addition, adjustable positions in the holder 14 for a conventional baby bottle 28 will be discussed.

Figure 2:
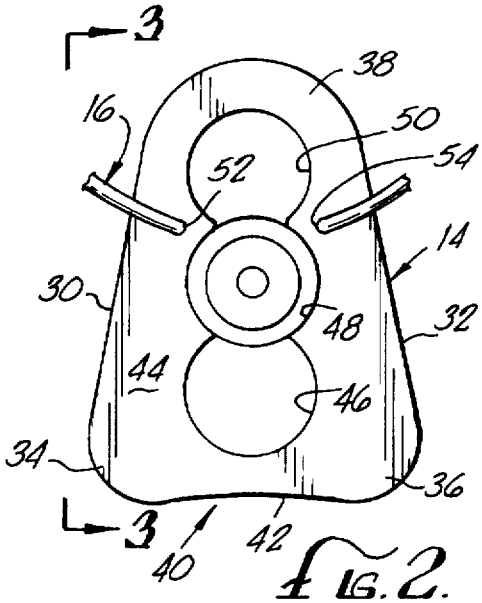
FIG. 2 is a front elevational view of the baby bottle holder of the present invention.
Figure 4:
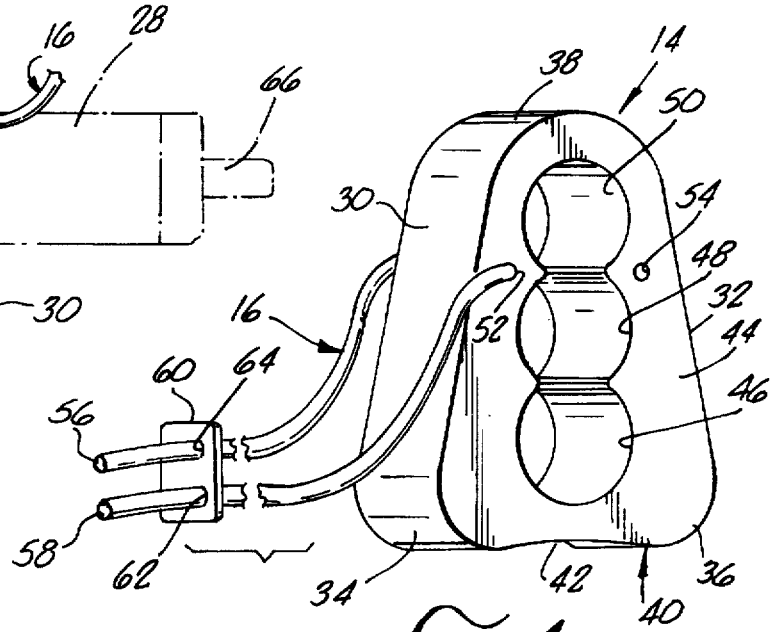
FIG. 4 is a perspective view of the baby bottle holder with an adjustable neck cord.

The baby bottle holder 14, when viewing it from the front, as seen in FIGS. 2 and 4 is generally a frusto triangular shaped holder. It has a pair of upwardly and inwardly angled biasing walls 30 and 32 that extend from lower rounded corners 34 and 36 respectively upward to a rounded top 38.

The bottom surface designated 40 includes an inwardly curved concaved bottom wall 42 that extends horizontally between the curved lower ends 34 and 36. The purpose of having the bottom wall 42 curved is so that as it rests on the clothes of the baby 12 and if there are any buttons or the gathering of clothes the holder 14 will not be distorted or tip over because of the protuberance.

Figure 3:
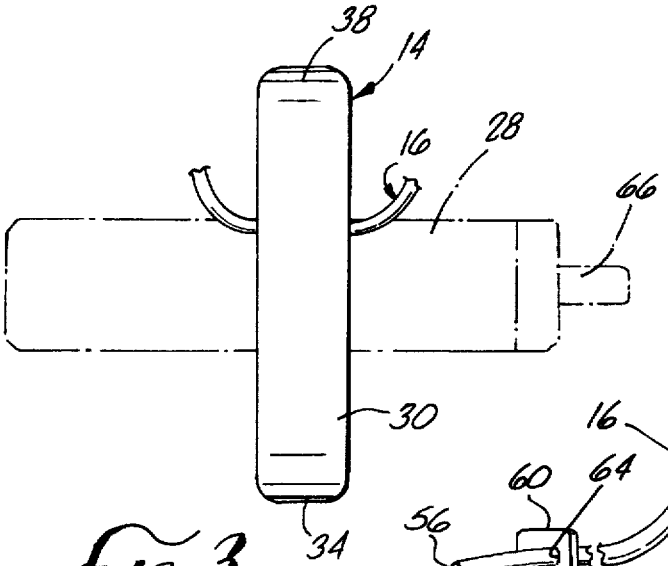
FIG. 3 is a view taken on line 3—3 of FIG. 2 showing a baby bottle in ghost lines.

As can be seen in FIGS. 3 and 4 the thickness of the holder 14 is preferably uniform throughout its length.

In addition, the inventor contemplates that the holder 14 be formed from a resilient plastic foam. However, the molecular structure of the foam must be ridged enough so that it will support itself.

Within the flat face 44 a plurality of bottle adjustment retaining means or holes 46, 48 and 50 are cut through the entire thickness of the holder 14. In addition, there is an overlapping of the adjustment holes 46,48 and 50 so that a bottle 28 mounted in one opening 46 may be moved upward into either opening 48 or 50 without removing the bottle 28 from the holder. This may be accomplished because of the flexible resilient nature of the material that forms the inwardly biased walls 30 and 32.

In addition, the holder 14 is equipped with bores 52 and 54 that extend through the thickness of the material on either side of the series of holes 46, 48 and 50 above a horizontal center of the holder 14. Either bore 52 and 54 receives strap means or cord 16 through the upper half of the holder 14. By adjusting the cord 16 the holder 14 will assume a resting position against the chest of the person 10.

This resting will occur with the use of the strap means or cord 16 because of the off center positions of the bores 52 and 54, the holder 14 being tapered or triangular so that the top wall 30 will be pulled against the person's chest, as shown.

The reason for two bores 52 and 54 is so that the holder 14 may be used by a person 10 holding the baby 12 in the left hand as shown in FIG. 1, or in the right hand, in which case the holder 14 is reversed and wall 32 will be pulled against the chest.

The cord 16 may be of any desired material, such as nylon or other plastic, preferably that is pliable and smooth so as not to irritate the skin of the person 10. The cord 16 passes through one of the bores 52 or 54, as best seen in FIG. 4 and terminates in two ends 56 and 58.

In order to adjust the cord 16 and in turn the holder 14, a strap retention means or cinch plate 60 has two holes 62 and 64 through which lengths of the cord 16 pass. The cord 16 is passed over the person's head, see FIG. 1, and a cinch plate 60 is pulled or pushed inward or outward as required to in turn move the baby bottle holder 14 to the desired position as seen in FIG. 1.

While the inventor has illustrated a cinch plate 60, type of clip, such as an alligator clip may be used without departing from the spirit of the invention. The alligator clip can also be released easily and thus the strap may be removed without disturbing the baby.

The main purpose of the bottle holder 14 is for use when the person 10 is holding the baby 12. However, the holder 14 may be used without the cord 16 extending around the neck. In that case the baby is lying on its back in a crib, etc. In that position the bottle 28 is inserted into cutouts 46, 48, or 50 as shown in FIG. 3. The holder 14 is set to rest with the concaved curving bottom wall 42 on the chest of the baby and then the bottle 28 is pushed outward from the holder 14 so that as the holder is tipped toward the baby's face and the nipple 66 of the bottle will be inserted in the mouth. Thus a triangle is formed by the baby's chest, holder 14 and the bottle 28.

In this way it may only be necessary for the person 10 to steady the bottle 28 with one hand during the time of the feeding.

In addition, the inventor contemplates the use of the holder 14 with a baby stroller as a stand-in for a person. The holder 14 may be affixed to the side of the stroller and the bottle inserted for the baby.

Also while three openings or holes 46, 48 and 50 are shown in the drawing the number may be increased or decreased and still be within the inventive concept. If the number is increased it may be necessary to expand the dimensions of the holder 14.

Finally, with the flexible feature of the material in the holder 14, baby bottles 28 of different shaped diameters may be used with equal effect.

The invention and its attendant advantages will be understood from the foregoing description and it will be apparent that various changes may be made in the form, construction and arrangements of the parts without departing from the spirit and scope thereof or sacrificing its material advantages, the arrangements herein before described being merely by way of example. I do not wish to be restricted to the specific forms shown or uses mentioned, except as defined in the accompanying claims, wherein various portions have been separated for clarity of reading and not for emphasis.

I claim:

1. A baby bottle holder to be used by a person feeding a baby wherein said holder and bottle do not require the use of the hands of said person, said holder comprising:

a generally triangular shaped body member of a solid resilient plastic foam having a common thickness and having a horizontal bottom wall for resting upon the chest of the baby and a pair of inwardly biased opposed side walls extending upwardly and inwardly from the bottom wall and linked together remote from said bottom wall, and one of said side walls being adapted for resting upon the chest of said person;

bottle adjusting frictional retaining means within said body member and including at least two circular vertically aligned cutouts passing through said thickness and said cutouts being interconnected whereby a bottle may be inserted within one of said circular cutouts and shifted vertically from one cutout to another without removing said bottle from the holder for frictionally positioning the bottle therein to a desired elevation best suited for contact with the mouth of the baby;

strap means associated with said body member to retain said one side wall against said person;

and retention means on said strap means for adjusting said strap means whereby said body member will rest against said person and also against said baby.

2. The baby bottle holder as defined in claim 1, wherein said strap means is an elongated cord that passes through said strap retention means and for passing around the neck of said person, and wherein said retention means adjusts said cord to position said one biasing wall to rest against said person with said bottom wall resting on said baby.

3. The baby bottle holder as defined in claim 1, wherein there are two strap receiving retention means and each comprised of a bore passing through the thickness of said body member, there being one said bore in each of said side walls.

4. The baby bottle holder as defined in claim 3, wherein said bores are in an upper portion of said body member and positioned over-center with respect to said cutouts so that said strap means will pull said inwardly biased side walls against the chest of a person.

5. The baby bottle holder as defined in claim 1, wherein said bottom wall of the body member is concave to receive any protuberance from clothing on said baby and so that the body member will rest on said baby unencumbered.

6. The baby bottle holder as defined in claim 1, wherein said retention means is a cinch plate with holes therethrough to pass lengths of the strap means to hold said strap means in adjusted positions.

7. The baby bottle holder as defined in claim 1, wherein said retention means is a cinch plate having two holes passing said retention means for adjustment.

8. A baby bottle holder to be used by a person feeding a baby wherein said holder and bottle do not require the use of the hands of said person in a feeding process, said holder comprising:

a frusto triangular shaped body member of a common thickness throughout, having a generally horizontal bottom wall and a pair of inwardly biased and opposed side walls inwardly tapering toward each other and one wall of which is adapted to rest against the person feeding the baby, and the generally horizontal bottom wall adapted to rest against said baby, bottle adjusting retaining means that includes at least two circular vertically aligned cutouts passing through said thickness and said cutouts being interconnected whereby a bottle may be inserted within one of said cutouts and shifted vertically from said one cutout to another without removing said bottle from said holder;

a strap passing through said body member in an upper portion thereof, said strap being adapted to pass around the neck of said person feeding said baby and be tightened or loosened to pull said one of said biasing walls against said person for effecting the resting of said holder in a position;

and said bottom wall being concave to receive protuberances from clothing on said baby so that said bottom wall will rest unencumbered against said baby.

9. A baby bottle holder to be used by a baby wherein said holder and bottle do not require the use of the hands of a person or the hands of a baby lying down, said holder comprising:

a generally triangular shaped body member of a solid resilient plastic foam having a common thickness throughout and having a bottom wall for resting upon the chest of the baby and a pair of inwardly biased opposed side walls extending upwardly and inwardly from the bottom wall and linked together by a top wall remote from said bottom wall, one of said side walls also being for resting upon the chest of said baby for adjustment, and bottle adjusting frictional retaining means within said body member and including at least two circular vertically aligned cutouts passing through said thickness and said cutouts being interconnected, whereby a bottle may be inserted within one of said circular cutouts and shifted vertically from said one cutout to another without removing said bottle from said holder for frictionally positioning the bottle therein and for placement in a desired position best suited for contact with the mouth of the baby.

10. The bottle holder as defined in claim 9, wherein said bottom wall of the body member is concave to receive any protuberance from clothing on said baby so that the body member will rest on said baby unencumbered.

* * * * *